United States Patent [19]

Cazaly et al.

[11] 4,312,167

[45] Jan. 26, 1982

[54] METHOD OF CONSTRUCTING A STORAGE TANK

[76] Inventors: Laurence G. Cazaly, 82 Green La., Thornhill, Ontario, Canada, L3T 2A1; Douglas Lamon, 494 Wentworth St. N., Hamilton, Ontario, Canada, L8L 5W9

[21] Appl. No.: 157,428

[22] Filed: Jun. 9, 1980

[51] Int. Cl.[3] ..... E04H 12/30

[52] U.S. Cl. ..... 52/745; 52/73; 29/445

[58] Field of Search ..... 52/745, 741, 73, 82, 52/192, 194; 220/1, 3, 18; 29/445, 421

[56] References Cited

U.S. PATENT DOCUMENTS

| | | | |
|---|---|---|---|
| 2,036,180 | 3/1936 | McNeil . | |
| 2,899,820 | 8/1959 | Headrick . | |
| 3,073,018 | 1/1963 | Gauthron | 52/73 X |
| 3,866,382 | 2/1975 | Van Tassel | 52/741 |
| 3,895,473 | 7/1975 | Fraser | 52/745 |
| 4,068,419 | 1/1978 | Decoppet | 52/73 X |

FOREIGN PATENT DOCUMENTS

| | | | |
|---|---|---|---|
| 763811 | 7/1967 | Canada . | |
| 1015122 | 8/1977 | Canada . | |
| 1038643 | 9/1978 | Canada . | |
| 574513 | 9/1977 | U.S.S.R. | 52/194 |

OTHER PUBLICATIONS

"Water Tank", Engineering News-Record, Feb. 14, 1963, p. 69.

*Primary Examiner*—J. Karl Bell

*Attorney, Agent, or Firm*—Moss, Bensette, Thompson, Squires

[57] ABSTRACT

A method of constructing an elevated liquid storage tank is disclosed wherein an upright, cylindrical, reinforced concrete shell is erected using a centrally located co-axial scaffold having a concentric working platform slideably mounted thereon, and a working crane mounted on the top of the scaffold. An annular steel tank is fabricated concentrically about the base of the upright cylindrical shell. The tank has floor and roof openings for the upright shell to pass therethrough. The tank is raised to the top of the upright shell, and a reinforced concrete tank floor is poured to sealingly close the tank floor opening. The concrete tank floor interlocks with the upright shell to secure the tank in position.

20 Claims, 9 Drawing Figures

METHOD OF CONSTRUCTING A STORAGE TANK

This invention relates to the construction of elevated storage tanks for the storing of liquids, and in particular water.

Elevated water storage tanks, which are sometimes referred to as water towers, have been constructed in the past primarily of two materials, namely, reinforced or prestressed concrete and structural steel. In general, the prior art storage tanks have been constructed either of one of these materials or the other. A common form of reinforced concrete tower has comprised a single vertical cylinder. Steel water towers produced in the past have commonly consisted of a tank supported by cross-braced tubular columns. These prior art tanks, however, have generally been considered to be lacking in aesthetic appeal.

In order to improve the appearance of the prior art towers, conical, drum-shaped or bulbous tanks have been produced, and these tanks have been mounted at the top of upright support columns. A difficulty with these tanks, however, is that they are generally not considered to be very economical to construct in either material taken separately.

In the present invention, an elevated storage tank with a pleasing appearance is constructed using a method which combines the use of reinforced concrete and structural steel in an economical and efficient manner.

According to the invention, there is provided a method of constructing an elevated liquid storage tank. The method comprises the steps of erecting an upright, cylindrical, reinforced concrete shell having a base portion located at ground level and an upper distal portion located at the top of the upright shell. An annular steel tank is fabricated concentrically about the base portion, the tank defining floor and roof openings for the upright shell to pass therethrough. The tank is raised to the upper distal portion. Also, a reinforced concrete tank floor is constructed to sealingly close the tank floor opening and secure the tank in position at the upper distal portion of the upright shell.

A preferred embodiment of the invention will now be described, by way of example, with reference to the accompanying drawings, in which.

Figures 1, 2, 3:
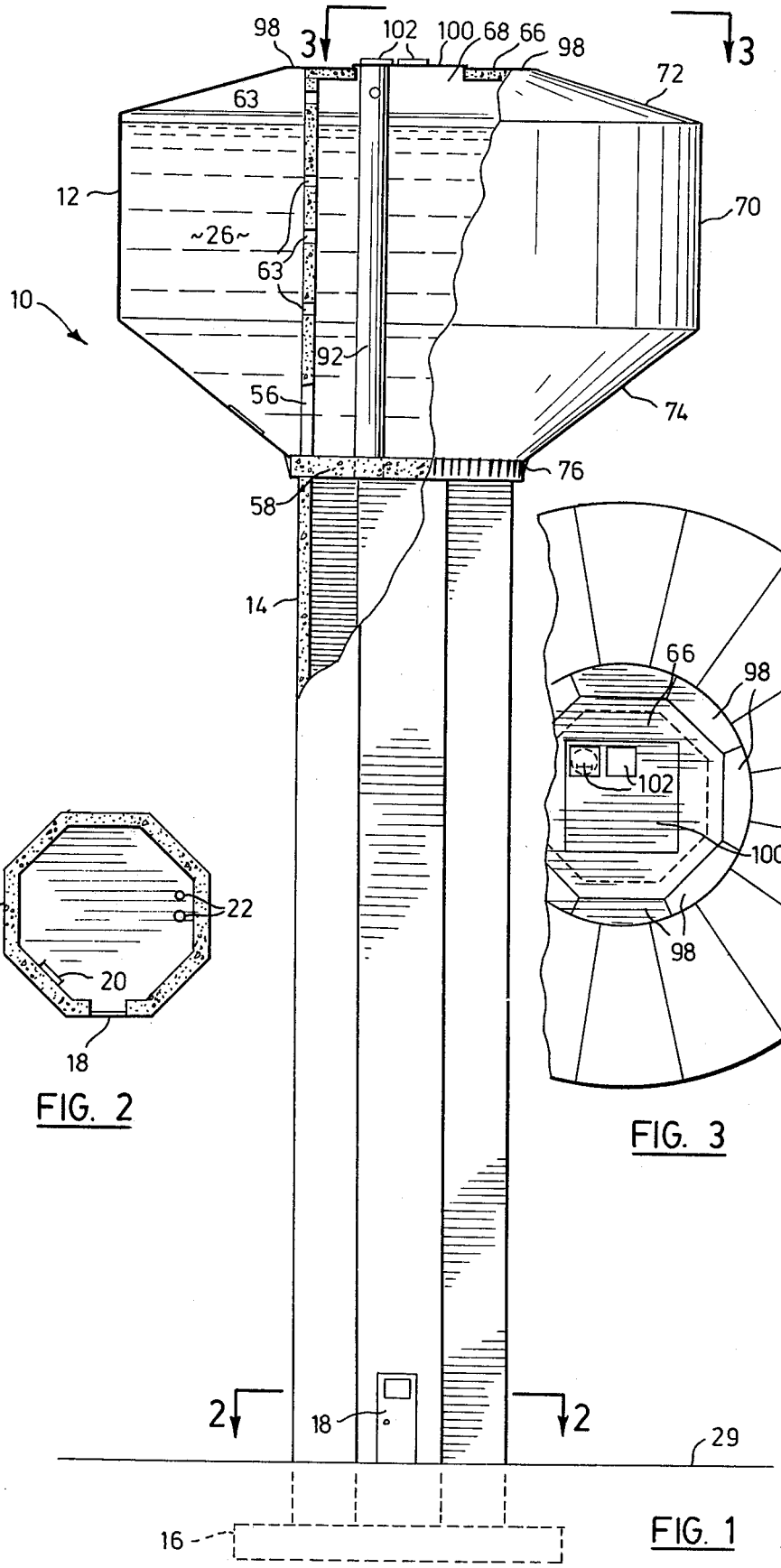
FIG. 1 is a diagrammatic, elevational view, partly broken away, of an elevated storage tank constructed according to the method of the present invention.
FIG. 2 is a sectional view taken along lines 2—2 of FIG. 1.
FIG. 3 is a partial plan view taken along lines 3—3 of FIG. 1.

Referring to the drawings, an elevated storage tank or water tower is generally indicated in FIG. 1 by reference numeral 10. Storage tank 10 includes a tank 12 and an upright, hollow, cylindrical column or shell 14. Upright shell 14 is formed of steel-reinforced concrete, but for the purpose of clarity, the reinforcing steel has been omitted from the drawings. The exact pattern and type of steel reinforcing is considered to be conventional, and typically comprises steel reinforcing bar and welded wire mesh as required.

Upright shell 14 is anchored to a supporting base foundation 16 indicated by dotted lines in the drawings. Foundation 16 is not considered to be part of the present invention, and therefore, will not be described in further detail. However, it will be noted that foundation 16 may be of any suitable type depending upon soil conditions. For example, a concrete slab or spread footing foundation could be used, or a pile type foundation may be required in some locations. In any event, the foundation must be capable of supporting the tower and the weight of the water contained in tank 12, as described further below.

Upright shell 14 is octagonal in cross-section in the embodiment shown in the drawings. For the purposes of this disclosure, the term "cylindrical" when used to describe shell 14 is intended to include any desired cross-sectional configuration, such as circular, octagonal, hexagonal, etc. Shell 14 also includes a ground level access door 18, a ladder 20 (see FIG. 2) for climbing shell 14, and inlet and outlet piping 22 for tank 12.

The dimensions of elevated storage tank 10 depend upon the particular application, but typically, the diameter or width of upright shell 14 across the flats is approximately 20 to 30 feet, and the height of storage tank 10 normally varies from about 80 to 150 feet. Tank 12 typically contains between 150,000 and 500,000 imperial gallons of liquid, the liquid being indicated in FIG. 1 by reference numeral 26.

Figure 6:
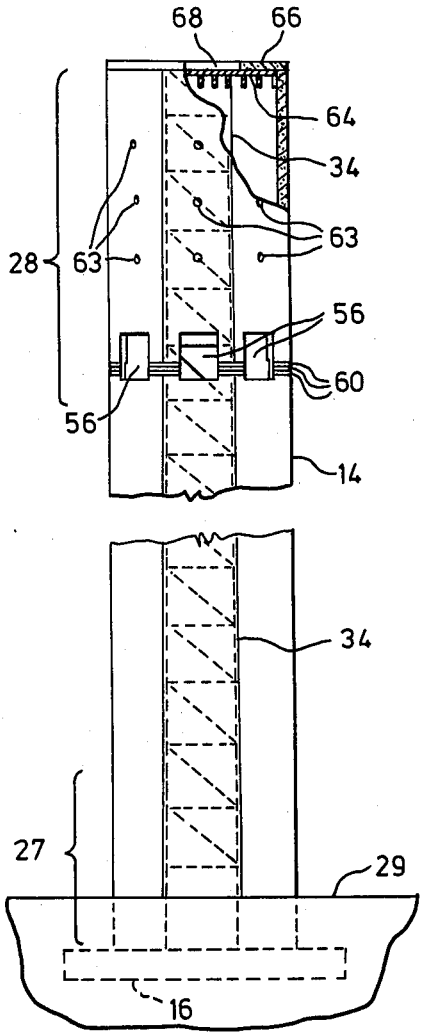
FIG. 6 is a diagrammatic, elevational view, again partly broken away, showing the upright shell nearing completion with forms in place for pouring the roof closing portion.

Once a suitable base foundation 16 has been constructed, the method of constructing elevated storage tank 10 commences with the erection of upright shell 14. As seen best in FIG. 6, shell 14 has a base portion 27 and an upper distal portion 28. Base portion 27 is located generally at ground level 29. Although base portion 27 extends from foundation 16 above ground level 29 as indicated in FIG. 6, base portion 27 could be considered to extend upwardly to distal portion 28. Upper distal portion 28 is located at the top of upright shell 14.

Figure 4:
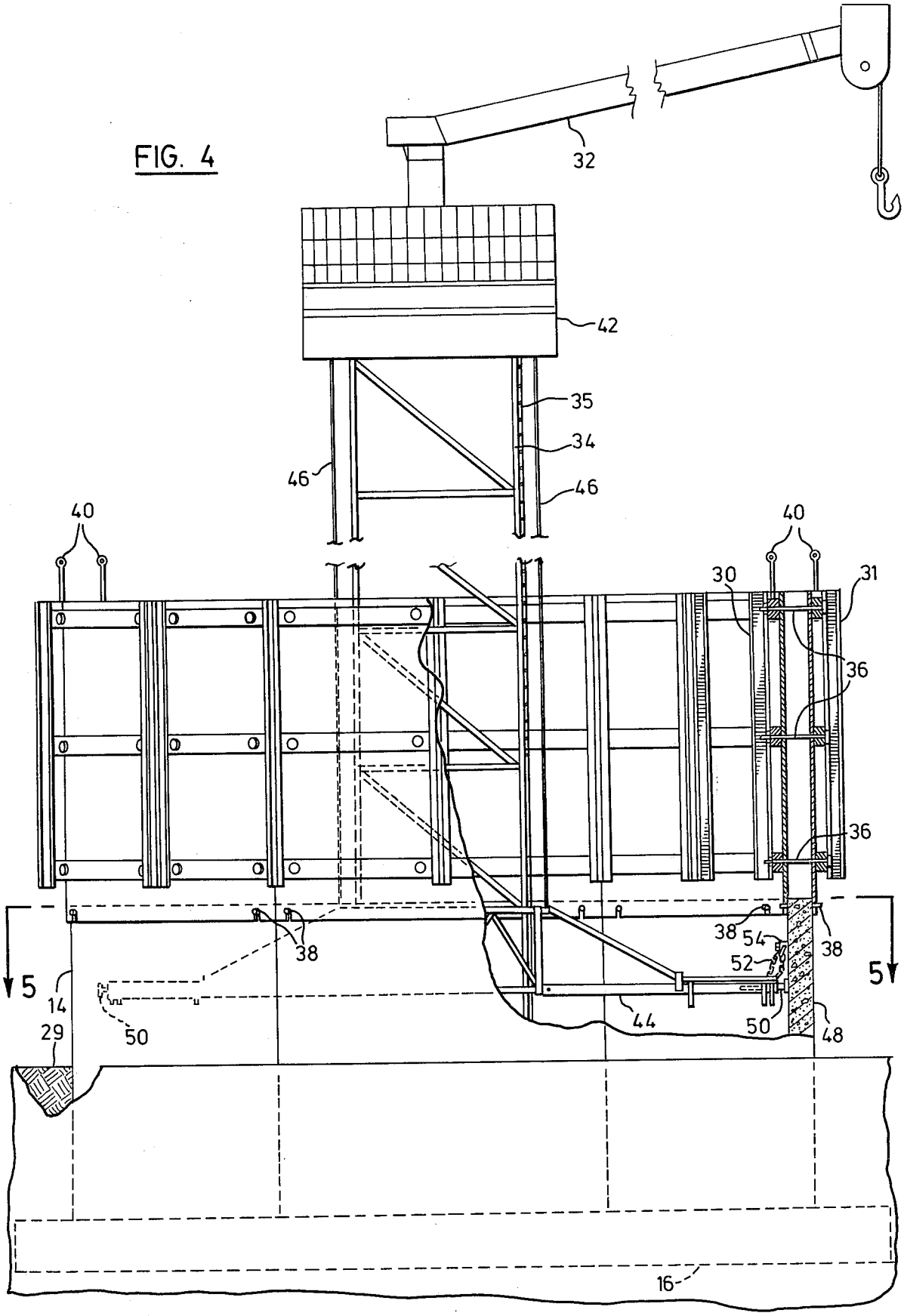
FIG. 4 is an enlarged elevational view, partly broken away, of the base portion of the upright shell of the storage tank shown in FIG. 1, illustrating the initial steps of constructing the upright shell.

Referring in particular to FIG. 4, upright shell 14 is erected using a jump forming technique employing forms 30, 31, which are manipulated by a crane 32 operatively mounted at the top of a scaffold 24. Forms 30, 31 may be of any suitable type, but preferably, these forms comprise a plurality of circumferentially arranged segments releasably held together along adjacent vertical peripheral edges. As seen in FIG. 4, there are inside forms 30 and outside forms 31, and forms 30, 31 are concentrically arranged to define an annular space therebetween to be filled with concrete. Forms 30, 31 are retained in spaced relation by ties 36, the uppermost ones of which remain in the concrete after pouring to act as lower support pins 38 to help retain and clamp the forms in position. The lower ties are removed when the forms are jumped and are re-used higher up. Ties 36 are retained by fixed nuts at the outside, so that they can be released from the inside of shell 14. Forms 30, 31 are also guyed to scaffold 34 for support.

The form segments are prefabricated and are approximately 6 feet to 10 feet in height and 10 feet to 14 feet in width. The forms have a durable, easily released finish, such as a fibreglass reinforced plastic coating. Forms 30, 31 and ties 36 allow complete assembly from the interior of shell 14, without the necessity of having to work at the exterior of the structure. Forms 30, 31 are lifted or raised using lifting rods 40, only a few of which are shown in FIG. 4 for the purpose of clarity. Lifting rods are attached to the forms adjacent to the sides of each form segment.

Figure 5:
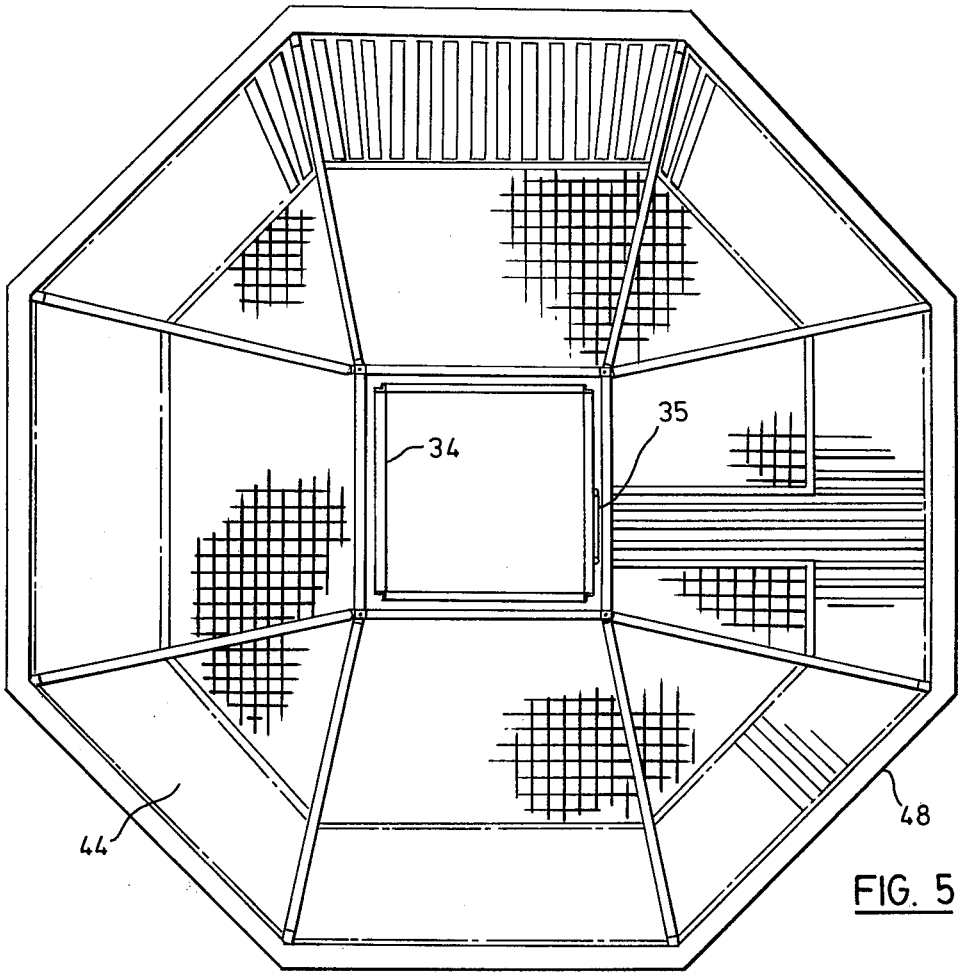
FIG. 5 is a plan view taken along lines 5—5 of FIG. 4; showing the working platform.

In the preferred embodiment scaffold 34 is erected in stages during the construction of shell 14. At the outset, scaffold 34 is erected to a height of approximately 40 feet to form a support tower for a crane head 42 upon which crane 32 is mounted. Scaffold 34 is of sufficiently heavy construction to support a crane load of approximately 6,000 pounds. Scaffold 34 must also support a working platform 44 weighing approximately 8,000 pounds concentrically mounted about scaffold 34 for vertical movement inside upright shell 14. Working platform 44 is suspended by lifting cables 46 connected between crane head a42 and working platform 44. Scaffold 34 must also be sufficiently strong to support the loading of the forms and concrete during construction of storage tank 10. Scaffold 34 may be dismantled for removal or to lower its height, and for this purpose, the scaffold components and access door 18 are dimensioned to permit removal of the scaffold through door 18 after construction is completed. Scaffold 34 also includes a ladder 35 (see FIGS. 4 and 5) and rest platform (not shown) to enable workmen to climb the scaffold. It will be appreciated that the working tower or scaffold 34 and working platform 44 are co-axially or concentrically mounted for vertical movement inside upright shell 14.

The exact configuration of forms 30, 31, scaffold 34, crane head 42, crane 32 and working platform 44 may be varied somewhat within the scope of the present invention. However, the components described have certain particularly useful features which will become apparent from the following description of the method of erecting storage tank 10.

As mentioned above, upright shell 14 is erected using a step forming technique. An initial or first wall section 48 of upright shell 14 is erected on foundation 16 using forms 30, 31 located directly on foundation 16. Also as mentioned above, the wall sections of upright tower or shell 14 include reinforcing steel which is not shown in the drawings. It will be understood, however, that before the concrete is poured for each stage of the erection of shell 14, suitable reinforcing steel is positioned between forms 30, 31. Actually, the reinforcing steel is positioned after outside forms 31 are positioned, but before the inside forms 30 are assembled for each stage of erection of shell 14. Concrete is then poured between the forms in the conventional manner, and after the concrete is hardened or set, the forms are raised in preparation for pouring of the next stage of construction.

First wall section or stage 48 is erected before working platform 44 is mounted on scaffold 34. After the concrete of first wall stage 48 has set, exterior or outside forms 31 are released from inside the structure and hoisted into position for the pouring of the second stage of construction of upright shell 14. The inside forms 30 are also released and raised into position for pouring of the second stage. FIG. 4 shows both the inside and outside forms 30, 31 in position for pouring of the second stage of construction of shell 14. At this point, working platform 44 is erected inside first stage 48 and lifting cables 46 are attached to subsequently lift the working platform.

Subsequent stages of the construction or erection of upright shell 14 are constructed in a manner similar to the first two stages. In the case of each stage, the outside forms 31 are released, raised using crane 32 and lifting rods 40, and refastened. The reinforcing steel is secured in position. Inside forms 30 and working platform 44 are then raised and secured. The forms are then guyed to the scaffold for alignment and support, and the concrete is poured. In connection with the securing of working platform 44, it will be noted from FIG. 4 that the periphery of the working platform is provided with radial jack screws 50 which bear against the inside of the wall of upright shell 14. Also, chains 52 attach the peripheral edges of working platform 44 to inside forms 30 or to concrete anchors 54 to provide further support for the working platform. It will be apparent that jack screws 50 are retracted and extended as required for the vertical movement of working platform 44. Concrete anchors 54 are also used to guy scaffold 34 to the wall of shell 14 (at 50 foot intervals) for extra rigidity and security during construction.

The step forming technique described above is utilized until upright shell 14 reaches its full height, as indicated in FIG. 6. It will be noted, however, from FIGS. 6 and 8 that the upper distal portion 28 includes a plurality of peripheral openings 56 in the shell wall. Openings 56 are formed by making suitable modifications to forms 30, 31 during the appropriate stage of construction of upright shell 14. Peripheral openings 56 are spaced below the top of shell 14 a distance corresponding to the height of tank 12, so that a reinforced concrete tank floor 58 (see FIG. 1) passes through peripheral openings 56 to lockingly secure the tank 12 in position. Peripheral openings 56 from part of interlocking means in upper distal portion 28. The interlocking means is positioned at a predetermined desired location of the concrete tank floor, so that the concrete tank floor 58 engages the interlocking means to secure the tank in position.

Figure 9:
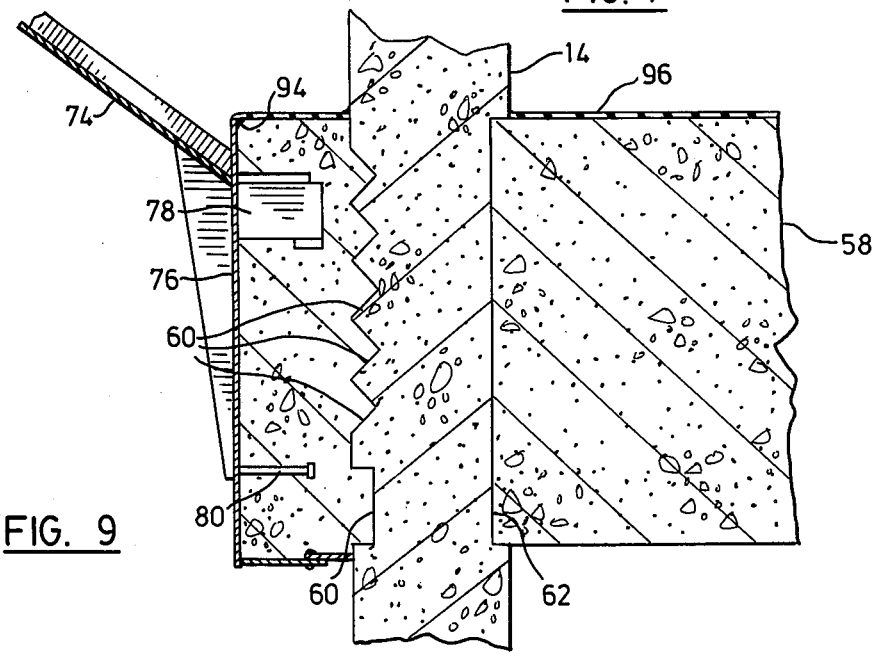
FIG. 9 is a vertical partial sectional view taken along lines 9—9 of FIG. 8, but after the construction of the concrete tank floor has been completed.

Referring to FIG. 9, the means of interlocking tank 12 to upright shell 14 also includes a plurality of generally horizontal keying grooves 60 formed in the outer surface of upright shell 14. Further, the interlocking means includes a plurality of inner grooves 62 formed in the inside surface of upright shell 14. It will be apparent that keying grooves 60 and inner grooves 62 are formed in the wall of upright shell 14 by making suitable modifications to forms 30, 31.

Figure 7:
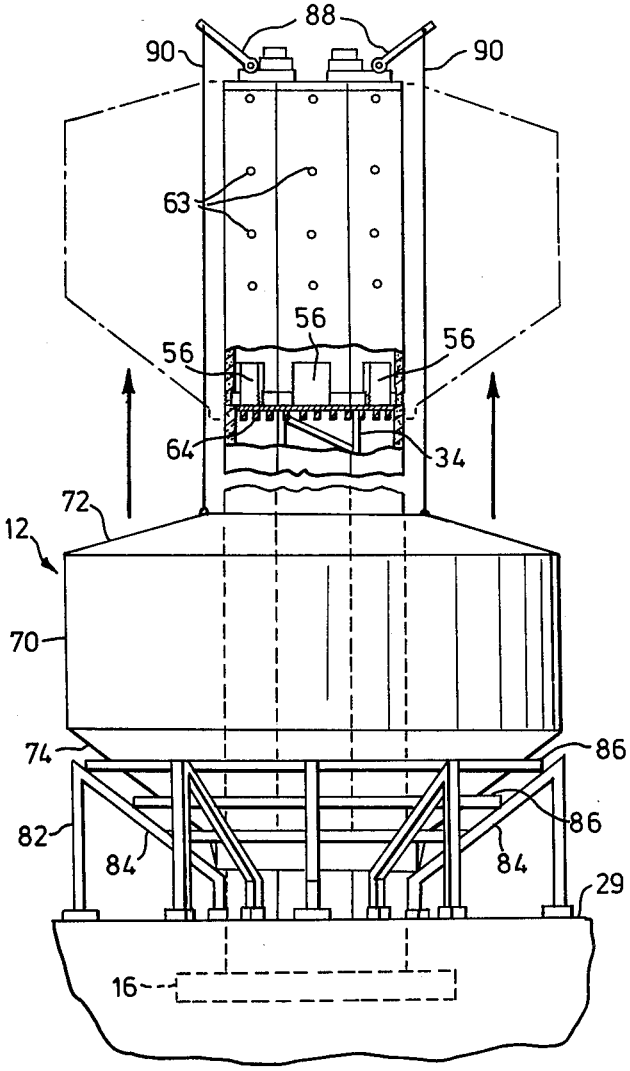
FIG. 7 is a diagrammatic, elevational view of the storage tank showing the annular steel tank fabricated at the base of the upright shell about to be raised into position at the top of the shell.

It will also be noted from FIGS. 1, 6 and 7 that the upper distal portion 28 of shell 14 is formed with a plurality of circulation openings 63 in the wall of the shell. These openings are also formed by making suitable modifications to forms 30, 31. Circulation openings 63 are provided to permit free flow of liquid therethrough and equalization of pressures on either side of the wall of shell distal portion 28.

When upright shell 14 has been erected to its full height, a transverse form 64 (see FIG. 6) is mounted on scaffold 34 at the top of shell 14. A reinforced concrete roof closing portion 66 is then constructed on form 64 to complete the erection of upright shell 14. Roof closing portion 66 has a central access opening 68, but otherwise roof closing portion 66 substantially closes the top of shell distal portion 28. Access opening 68 permits scaffold 34 to pass therethrough, so that the scaffold and crane 32 do not have to be removed before the roof closing portion 66 is constructed. When the concrete of roof closing portion 66 has hardened, crane 32 and crane head 42 are removed and scaffold 34 is lowered, so that the upper surface of transverse form 64 is adjacent to the bottoms of peripheral openings 56, as seen best in FIGS. 7 and 8. Transverse form 64 is then in position for the pouring of the reinforced concrete tank floor 58, as described below.

Tank 12 is next fabricated concentrically about the base portion 27 of upright shell 14. Referring to FIGS. 1, 3, 7 and 8, tank 12 is in the form of an annular steel shell having straight cylindrical side walls 70, and an upwardly and inwardly disposed conical tank roof 72 defining a central, upper, concentric roof opening. Tank 12 also includes a downwardly and inwardly disposed conical annular wall 74. Annular wall 74 includes an annular lower skirt 76 defining a tank floor opening. As seen best in FIG. 7, the tank roof and floor openings permit upright shell 14 to pass therethrough. Shell 14 is used to align tank 12 during construction, thereby accurately controlling the shape of the tank.

Figure 8:
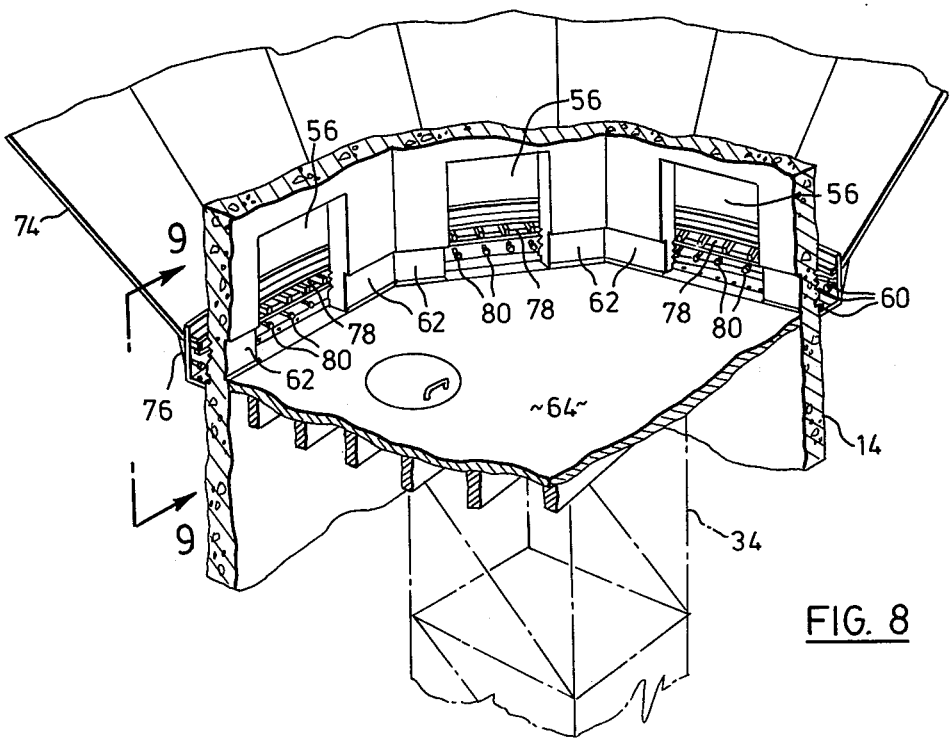
FIG. 8 is a partial perspective view of the inside of the upright shell showing the tank in position and forms in place for constructing the reinforced concrete tank floor.

As seen best in FIGS. 8 and 9, annular lower skirt 76 includes inwardly projecting anchor means 78, 80 for engaging the poured concrete tank floor 58 to help secure the tank in position.

As seen best in FIG. 7, annular steel tank 12 is fabricated by first erecting a supporting jig 82 at the base portion 27 of upright shell 14. Jig 82 includes a plurality of radially upwardly and outwardly extending beams 84, and a plurality of optional concentric hoops or rings 86.

Prior to fabricating annular lower skirt 76, the steel used for the inside surfaces of this skirt and anchor means 78, 80, is metallized. The metallizing process typically involves the flame spraying of zinc on the metal surfaces to form a zinc coating approximately 0.008 inches (0.2 millimeters) in thickness. The remaining steel surfaces of tank 12 are painted or otherwise coated in a conventional manner.

The next step is to raise tank 12 to the upper distal portion 28 of shell 14, as illustrated in FIGS. 1 and 8. Referring to FIG. 7, tank 12 is raised using suitable lifting mechanisms 88, the tank being suspended by cables 90. Cables 90 are attached to suitable brackets (not shown) temporarily fastened to lower skirt 76 of the tank. The brackets include suitable guides, such as nylon wheels, which engage the outside of shell 14 to retain and guide the tank as it is raised or slid up shell 14. The guides prevent the tank and shell 14 from being damaged as the tank is raised to the top of shell 14.

When the tank is in position at the top of upright shell 14, it is wedged in position to prevent the tank from swaying while the tank floor is cast. The concrete is then poured for tank floor 58, once again after installing suitable reinforcing steel for the tank floor. Referring to FIG. 1, prior to the pouring of concrete tank floor 58, an access tube 92 is positioned inside tank 12 for access to the roof of tank 12 from inside upright shell 14 below tank floor 58. Also prior to pouring the concrete of tank floor 58, the inside surfaces of lower skirt 76, including anchor means 78, 80 are coated with an epoxy resin or bonding agent of a type that will bond to concrete cast against it. This epoxy resin at the interface of the skirt and tank floor seals the metallizing and helps to bond the skirt to the tank floor to prevent leaks. After the concrete of tank floor 58 is cast, but before it has hardened, the peripheral edge portion of the concrete tank floor 58 is bevelled to provide a bevelled edge 94 adjacent to the top edge portion of lower skirt 76. This forms a peripheral groove which is filled with epoxy resin or other sealant to caulk the joint between the tank floor and lower skirt 76.

Next, after the concrete tank floor 58 has hardened, the inside surface of the tank floor and adjacent portions of the tank skirt and shell distal portion are coated with a surfacing material such as latex mortar or a polymer-cement material to form a waterproof layer 96 to further waterproof the tank floor. A suitable polymer-cement material for this purpose is marketed under the name TAPECRETE, which is a trade mark owned by FRC Composites Limited of Don Mills, Ontario, Canada.

The floor thus completed to sealingly close the tank floor opening and secure the tank in position, the tank roof opening is now closed by installing upper peripheral plates 98 (see FIG. 3) between the adjacent peripheries of roof closing portion 66 and tank roof 72. Although roof closing portion 66 is dimensioned to substantially close the tank roof opening when the tank is raised into position, upper peripheral plates 98 act as a sort of bellows to permit a limited amount of vertical movement of the tank roof caused by expansion and contraction of the tank and the initial loading of the tank when first filled with liquid. Peripheral plates 56 are strong horizontally, and therefore provide significant lateral support to the tank, relieving the tank floor connection of the need to perform this function. Finally, a top cover 100 is installed over central access opening 68, and suitable access covers 102 are provided in top cover 100 for permitting access to the inside of tank 12 from access tube 92.

Having described a preferred embodiment of the method of constructing a liquid storage tank according to the present invention, it will be appreciated that various modifications may be made to the steps involved and the structure described above. For example, other means could be employed for interlocking the steel tank to the concrete upright shell than the peripheral openings 56 described. The peripheral openings could be replaced with recesses only, similar to keying grooves 60 and inner grooves 62. However, the relatively large peripheral openings 56 provide very positive interlocking, and they also permit the free flow of water through the walls of upper distal portion 28. Peripheral openings 56 are typically about 3 feet in width and 6 feet in height to provide ample access to all portions of the inside of tank 12 during construction, and to leave openings after the tank floor 58 is cast for the flow of water therethrough. Openings 56 also provided access to the inside walls of tank 12 for maintenance. As a further alternative, the interlocking means for locking tank 12 to upright shell 14 could also be in the form of suitable anchors cast into the wall of upper distal portion 28.

It will be appreciated that elevated storage tank 10 could be used for storing other liquids than water, and that the design of the tank may be varied to suit the particular application. The concrete used for shell 14 could be prestressed or reinforced in other ways. Also, other cross-sectional configurations of cylindrical shell 14 could be produced, such as circular, hexagonal, square, etc.

As mentioned above, modifications may be made to the various pieces of apparatus used to construct the elevated storage tank. For example, other means, such as jacks, could be employed to raise the tank into position after it is fabricated. Other types of concrete forms could be used, as well as other types of cranes, scaffolding, and working platform. Various modification may also be made to the steps of the method of the invention and the order in which these steps are performed.

In conclusion, the method of the present invention produces an elevated storage tank which is relatively simple and inexpensive to construct, and yet is capable of storing large volumes of liquid. The reinforced concrete and structural steel construction materials are each used to the best advantage. In addition, the possibility of leakage at the steel and concrete interface is minimized and the life of the tower is maximized due to the method of construction.

What we claim is:

1. A method of constructing an elevated liquid storage tank, the method comprising:

erecting an upright, cylindrical, reinforced concrete shell having a base portion located generally at ground level and an upper distal portion located at the top of the upright shell;

fabricating concentrically about said base portion an annular steel tank, the tank defining floor and roof openings for the upright shell to pass therethrough;

raising the tank to the upper distal portion; and constructing a reinforced concrete tank floor to sealingly close the tank floor opening and secure the tank in position at the upper distal portion of the upright shell.

2. A method as claimed in claim 1 wherein the upright shell is erected by providing an inner co-axially disposed scaffold and a working platform concentrically mounted about the scaffold for vertical movement inside the upright shell.

3. A method as claimed in claim 2 wherein the upright shell is erected using a jump forming technique employing forms manipulated by a crane operatively mounted at the top of the scaffold.

4. A method as claimed in claim 1 wherein the erection of the upright shell includes the step of forming interlocking means in the upper distal portion at a predetermined desired location of the concrete tank floor, so that the concrete tank floor engages the interlocking means to secure the tank in position.

5. A method as claimed in claim 4 wherein the forming of said interlocking means includes the forming of means defining a plurality of peripheral openings in the shell wall, said openings being spaced below the top of the shell, whereby the reinforced concrete tank floor passes through said peripheral openings to lockingly secure the tank in position.

6. A method as claimed in claim 4 wherein the forming of said interlocking means includes the forming of means defining a plurality of generally horizontal keying grooves formed in the outer surface of the upright shell.

7. A method as claimed in claim 6 wherein the forming of said interlocking means further includes the forming of means defining a plurality of inner grooves formed in the inside surface of the upright shell.

8. A method as claimed in claim 4 wherein the erection of the upright shell includes the step of constructing a roof closing portion at the top of the shell distal portion, the roof closing portion being spaced above said interlocking means and dimensioned to substantially close the roof opening of the annular steel tank when the tank is raised into position.

9. A method as claimed in claim 1 and further comprising the preliminary step of constructing a base foundation for supporting the base portion of the upright shell.

10. A method as claimed in claim 1 wherein the fabrication of the annular steel tank includes fabricating a downwardly and inwardly disposed annular wall and an annular lower skirt defining the tank floor opening, the lower skirt having inwardly projecting anchor means for engaging the poured tank floor to secure the tank in position.

11. A method as claimed in claim 10 wherein the annular steel tank is fabricated by first erecting a supporting jig at the base portion of the upright shell.

12. A method as claimed in claim 10 wherein the fabrication of the annular lower skirt includes the preliminary step of metallizing the steel forming the inwardly disposed surfaces of the skirt.

13. A method as claimed in claim 12 wherein the fabrication of the annular lower skirt further includes the subsequent step of coating the inwardly disposed surfaces of the skirt with epoxy resin prior to pouring the concrete tank floor, thereby bonding the concrete to the lower skirt.

14. A method as claimed in claim 10 and further comprising the step after pouring the concrete tank floor of coating the inside surfaces of the tank floor and adjacent portions of the tank skirt and shell distal portion with a waterproofing surfacing material.

15. A method as claimed in claim 8 wherein the roof closing portion is constructed substantially of reinforced concrete, and further comprising the step of attaching the periphery of the roof opening to the periphery of the roof closing portion.

16. A method as claimed in claim 15 wherein the peripheries of the roof opening and roof closing portion are attached using inner peripheral plate members forming bellows for permitting expansion and contraction of the tank while providing lateral support for the tank.

17. A method as claimed in claim 15 wherein the concrete tank floor and the roof closing portion are constructed by providing a scaffold co-axially located inside the upright shell and a transverse form mounted on the top of the scaffold, the scaffold being adjustable in height for locating said form firstly for pouring the concrete roof closing portion and then the tank floor.

18. A method as claimed in claim 4 wherein the upright shell is erected, the tank is raised, and the concrete tank floor is constructed by providing a variable height support scaffold co-axially located inside the shell, a working platform concentrically mounted on the scaffold for vertical sliding movement, and a crane removably mounted at the top of the scaffold, thereby permitting the liquid storage tank to be substantially constructed from the inside thereof.

19. A method as claimed in claim 12 and further comprising the step after pouring the concrete tank floor of coating the inside surfaces of the tank floor and adjacent portions of the tank skirt and shell distal portion with a waterproofing surfacing material.

20. A method as claimed in claim 13 and further comprising the step after pouring the concrete tank floor of coating the inside surfaces of the tank floor and adjacent portions of the tank skirt and shell distal portion with a waterproofing surfacing material.

* * * * *